US005466911A

United States Patent [19]

Spagnoli et al.

[11] Patent Number: 5,466,911

[45] Date of Patent: Nov. 14, 1995

[54] WINDOW ASSSEMBLY AND METHOD FOR ELECTRICALLY HEATING VEHICLE SIDE LITE

[75] Inventors: Robert A. Spagnoli, Fort Gratiot; Philip D. Janson, Lincoln Park, both of Mich.

[73] Assignee: Ford Motor Company, Dearborn, Mich.

[21] Appl. No.: 86,258

[22] Filed: Jul. 6, 1993

[51] Int. Cl.[6] ..... H05B 3/26

[52] U.S. Cl. ..... 219/203; 219/522

[58] Field of Search ..... 219/203, 522, 219/219; 454/124, 127, 121, 93; 15/250.003, 250.05; 359/512

[56] References Cited

U.S. PATENT DOCUMENTS

| | | | |
|---|---|---|---|
| 1,996,019 | 3/1935 | Hueber | 454/121 |
| 2,045,826 | 6/1936 | Benolken | 454/124 |
| 2,878,357 | 3/1959 | Thomson et al. | 219/203 |
| 3,475,588 | 10/1969 | McMaster | 219/203 |
| 3,794,809 | 2/1974 | Beck et al. | 219/203 |
| 4,410,843 | 10/1983 | Sauer et al. . | |
| 4,439,013 | 3/1984 | Hagn et al. | 454/124 |
| 4,543,466 | 9/1985 | Ramus . | |
| 4,634,242 | 1/1987 | Taguchi et al. | 359/512 |
| 4,864,100 | 9/1989 | Cicak | 219/203 |
| 4,918,288 | 4/1990 | Carter et al. | 219/203 |
| 4,981,072 | 1/1991 | Hanson et al. | 454/124 |
| 5,319,397 | 6/1994 | Ryden | 219/522 |

FOREIGN PATENT DOCUMENTS

| | | | |
|---|---|---|---|
| 2537652 | 3/1977 | Germany | 359/512 |
| 148435 | 5/1981 | Germany | 219/522 |
| 3139946 | 4/1983 | Germany | 359/512 |

*Primary Examiner*—John A. Jeffery
*Attorney, Agent, or Firm*—Lorraine S. Melotik; Roger L. May

[57] ABSTRACT

An electrically heated window assembly and method for heating a movable front door window (side lite) of a motor vehicle defrosts and deices the front window by producing a concentration of heat at the portion of the front window through which an operator or passenger of the vehicle views an exterior rear view mirror. To heat the window, a current flows between a first bus bar, positioned along the front edge of the window, and a second bus bar, positioned along the rear edge of the window. A conductive film provides the current path between the respective bus bars. A nonconductive break is formed in the conductive film substantially along the nominal door line of the window to prohibit heating of the window below the nominal door line. The first bus bar may preferably be arcuately-shaped to provide a uniform heating pattern on the window. Various control devices, such as temperature sensors and position sensors, are used to control the heating process.

4 Claims, 5 Drawing Sheets

WINDOW ASSSEMBLY AND METHOD FOR ELECTRICALLY HEATING VEHICLE SIDE LITE

BACKGROUND OF THE INVENTION

The present invention relates generally to electrically heated windows in a motor vehicle and, more particularly, to a window assembly and method for heating a movable front door window (side lite) in a motor vehicle wherein the generated heat is concentrated at the portion of the front window through which an operator of the vehicle views an exterior rear view mirror.

Manufacturers of motor vehicles have long recognized the advantages of having systems for defogging and deicing the windows of their vehicles. Previous systems have utilized the heat generated by the internal combustion in the engine to produce warm air which is circulated throughout the passenger compartment of the vehicle to defog and deice the windows. However, such systems experience a substantial time delay while the engine attains a sufficient temperature to heat the air. Furthermore, sufficient air passages must be installed within the vehicle to transport the warm air to the respective windows thus further restricting the amount of interior space available for passengers. As should be readily apparent, these problems are exacerbated the greater the distance from the window to the engine.

In an effort to alleviate these problems, vehicle manufacturers have affixed to the window a conductive film, or a series of small conductors, to generate heat when current flows therethrough. Although predominately used on the stationary front or rear windows of a vehicle, a few systems are known which are adapted to be used on the movable door windows, or side lites.

U.S. Pat. No. 4,410,843 issued to Sauer et al discloses an electrically controlled sliding window and proximity detector which includes a window heating system. The Sauer et al system uses heat generated by current flowing through a series of horizontal, parallel conductors. The series of conductors electrically interconnect a pair of bus bars which are connected to a current source, typically the vehicle battery or alternator. During heating, current generally flows from the current source to one of the bus bars and is then divided between the respective conductors.

As the current flows through the conductors heat is generated due to the resistance of the conductors. The current then returns to the current source via the other bus bar. The Sauer et al invention includes a control circuit for starting and stopping the heating process. A moisture detector monitors the condensation on the window to determine when the window needs defrosted or deiced.

The aforementioned prior art system designs have experienced some significant problems. For example, when deicing or defogging a front door window, it is imperative that the area of the window through which a driver views the exterior rear view mirror be clear. However, the noted prior art systems do not concentrate the heating in this area. For instance, the Sauer et al invention has parallel, horizontal conductors which divide the available heating current based on the respective impedances of the individual conductors. Consequently, the top of the window receives the most current and the highest level of heating. The rear view mirror area of the window does not receive a concentrated heating.

Since the heating current is not concentrated on the rear view mirror area of the window, a weak current source or a higher than normal conductive film resistance could substantially impair the heating of this vital area of the window. In addition, vehicle windows, especially front door windows, regularly have asymmetrical shapes. Thus, horizontal conductors traversing such a window have uneven lengths and unequal impedances causing unwanted irregular heating of the window.

It is thus apparent that there is a need in the art for an improved electrically heated window assembly and method for heating a movable front door window (side lite) of a motor vehicle wherein the heating current, and thus the generated heat, is substantially concentrated at the portion of the front door window through which an operator of the vehicle views an exterior rear view mirror (either operator-side mounted on passenger—side mounted or both) and wherein the heating pattern across the window is substantially uniform.

SUMMARY OF THE INVENTION

This need is met by the electrically heated window assembly and method for heating a movable, front door window (side lite) of the present invention wherein the generated heat is concentrated at the portion of the front window through which an operator of the vehicle views an exterior rear view mirror.

In accordance with one aspect of the present invention, an electrically heated window assembly includes a heating means which heats the front window in the aforesaid concentrated heating pattern by passing a current through a conductive film applied to the window. A first bus bar positioned along the front edge of the window is electrically connected to the conductive film. A second bus bar has a first section positioned along the bottom edge of the window and a second section, electrically connected to the first section and the conductive film, positioned along the rear edge of the window. The conductive film may have a nonconductive break formed therein which electrically isolates the first section of the second bus bar from the first bus bar. Current is supplied to the first and second bus bars via a power supply. Thus, current flows in the conductive film between the first bus bar and the second section of the second bus bar to defog or deice the window.

Preferably, the first bus bar is arcuately-shaped to provide a uniform heating pattern in the rear mirror viewing area. Various electrical control devices, such as temperature control means, temperature sensors, or position sensors, may be employed to control the heating process.

In accordance with another aspect of the present invention, a method for heating a window in a front door of a motor vehicle having at least one rear view mirror is provided. The method comprising the steps of: providing a heating means for heating the window; and using the heating means to heat the window whereby the portion of the window experiences an increased level of heating as compared to the remainder of the window.

It is thus a feature of the present invention to provide an improved electrically heated window assembly and method for heating a movable front door window wherein the generated heat is concentrated, in a uniform manner, in the portion of the of the front window through which an operator of the vehicle views an exterior rear view mirror.

Other features and advantages of the invention will be apparent from the following description, the accompanying drawings and the appended claims.

DETAILED DESCRIPTION OF THE INVENTION

Figure 1A:
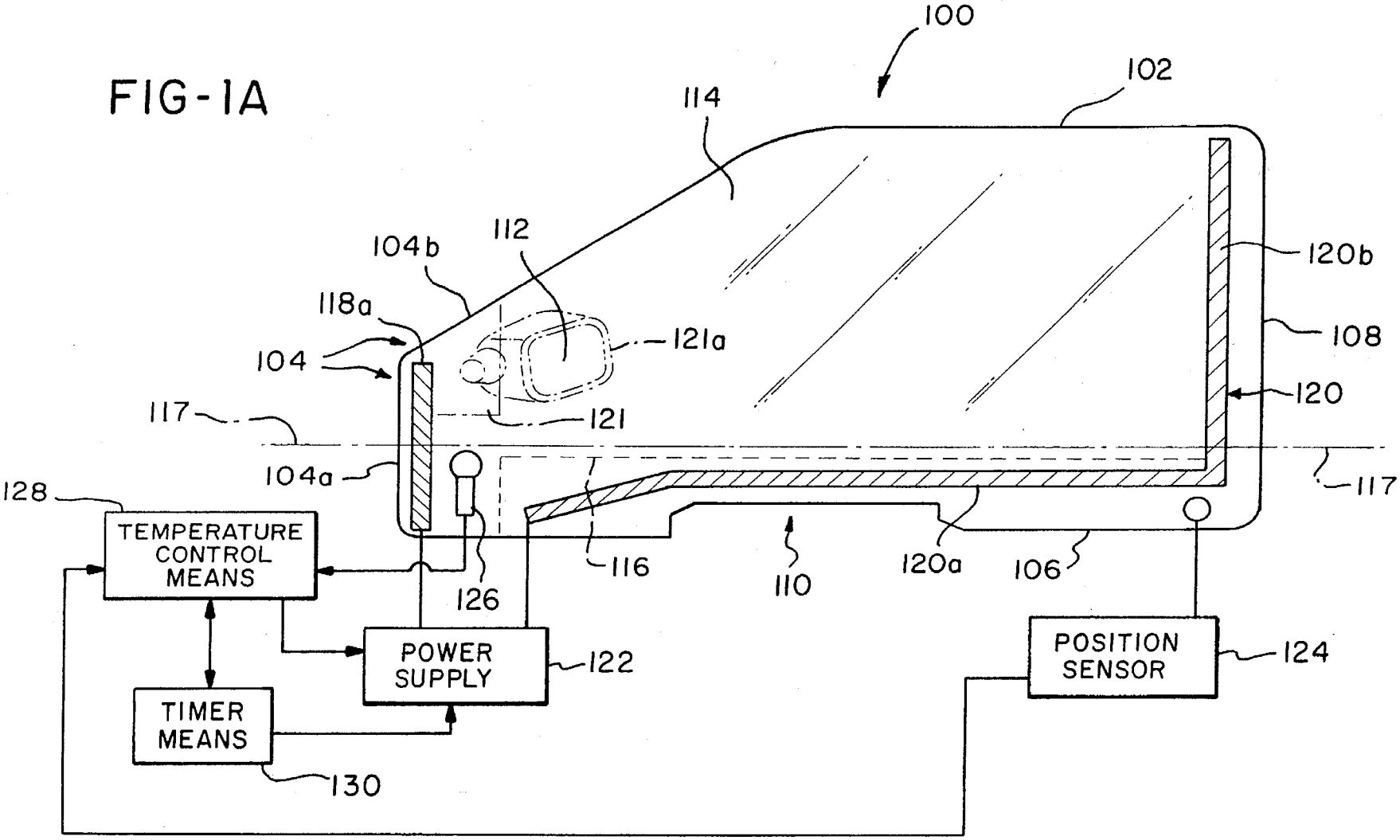
FIG. 1A is a side view of an electrically heated window assembly including a movable front door window (side lite) and first and second bus bars in accordance with the present invention.

An electrically heated window assembly 100, as shown in FIG. 1A, is adapted to be movably mounted in a front door of a motor vehicle. The window assembly 100 includes a conventional, slidable front door window (side lite) 102 for a motor vehicle. The window 102 has a front edge 104, a bottom edge 106 and a rear edge 108. The front edge 104 includes a substantially vertical front section 104*a* and an inclined front section 104*b*. The vertical front section 104*a* and the rear edge 108 contact the door window frame to guide the window 102 during opening and closing in a conventional manner, in the illustrated example, a cutout portion 110 is provided in the bottom edge 106 for mechanical clearance of a window operating mechanism contained in the door. Although the window 102 is shown with the cutout portion 110, the present invention can be advantageously employed with window operating mechanisms which do not require a cutout portion. Examples of such window operating mechanisms are well known in the art and, therefore, will not be further described herein.

In a conventional motor vehicle, rear view or side mirrors are provided on one or both of the exteriors of the front doors. When using a rear view mirror, a driver or passenger looks through a portion 112 of the window 102 generally toward the front of the vehicle when the window 102 is closed. Consequently, to provide the most efficient and effective defogging and defrosting of the window 102, the level of heating of the window 102 should be substantially concentrated in the portion 112.

Such a distribution of heat across the window 102 is provided by the window assembly 100 in accordance with the present invention. The window 102 is heated by the flow of current through an electrically conductive film 114 applied to the window 102 in a well known manner, such as by sputtering. The conductive film 114 may have a nonconductive break 116 located substantially along a nominal door line 117 of the front door when the window 102 is closed to prohibit current, and thus heat, below the nominal door line 117. In addition, nonconductive breaks are formed in the conductive film 114 to accommodate the first bus bar 118 and the second bus bar 120.

A heating means of the window assembly 100 consists of a first bus bar 118 positioned along the vertical front section 104a of the window 102 and a second bus bar 120 having a first section 120a positioned along the bottom edge 106 of the window 102 and a second section 120*b* positioned along the rear edge 108 of the window 102. The first and second sections 120*a*, 120*b* of the second bus bar 120 are electrically interconnected such that current can flow therebetween. Power supply 122, which may be the vehicle battery or alternator, provides current to the bus bars 118, 120.

The conductive film 114 secures the bus bars 118 and 120 against the window 102 and provides an infinite number of conductive paths for current to flow between the first bus bar 118 and the second section 120*b* of the second bus bar 120 above the nonconductive break 116 in a conventional manner. The nonconductive break 116 thus electrically isolates the first bus bar 118 from the first section 120*a* of the second bus bar 120 to substantially reduce undesirable heating of the window 102 below the nominal door line 117. Such conductive films 114, and the formation of nonconductive breaks therein, are well known and, consequently, will not be further described herein.

As shown in FIG. 1A, the first bus bar 118 in accordance with the present invention may be positioned substantially parallel to the vertical front section 104*a* of the window 102. In addition, the first section 120*a* of the second bus bar 120 is positioned so as to be inside the door, i.e. below the nominal door line 117, when the window 102 is closed. Consequently, the first section 120*a* of the second bus bar 120 is contained within the door during normal movement of the window 102. This configuration of bus bars 118, 120 produces efficient heating of the window 102 while occupying minimal window space and thus permitting a substantially unobstructed view through the window 102.

The front door may preferably include a rear mirror mount assembly 121 having an exterior rear view mirror 121*a* mounted thereon. Although the rear mirror mount assembly 121 is shown being translucent for ease of description, the rear mirror mount assembly 121 may actually enclose and conceal a portion of the front edge 104 of the window 102. In addition, the first bus bar 118 may be positioned along the vertical front section 104*a* of the window 102 such that the first bus bar 118 is concealed by the rear mirror mount assembly 121. Various rear view mount assembly configurations which may be advantageously employed in the present invention are known. Hence, it should be understood that the rear mirror mount assembly 121 is shown for illustrative purposes.

Various conventional electrical control devices may be employed to facilitate the defrosting and defogging of the window 102 in accordance with the present invention. A position sensor 124 senses the vertical position of the window 102 in the door and a temperature sensor 126 senses the temperature of the window 126. A temperature control means 128, in response to the position sensor 124 and the temperature sensor 126, controls the output of the power supply 122 to regulate the amount of current flowing through the conductive film 114 and thus the temperature of the window 102. In addition, a timer means 130 may be provided which interacts with the temperature control means 128 and the power supply 122 to reduce or interrupt the output of the power supply 122 at a predetermined time. As will be apparent to those skilled in the art, the aforesaid control circuits, or devices, are well known in the art and, therefore, their structure and philosophy of operation will not be further described herein.

Figure 1B:
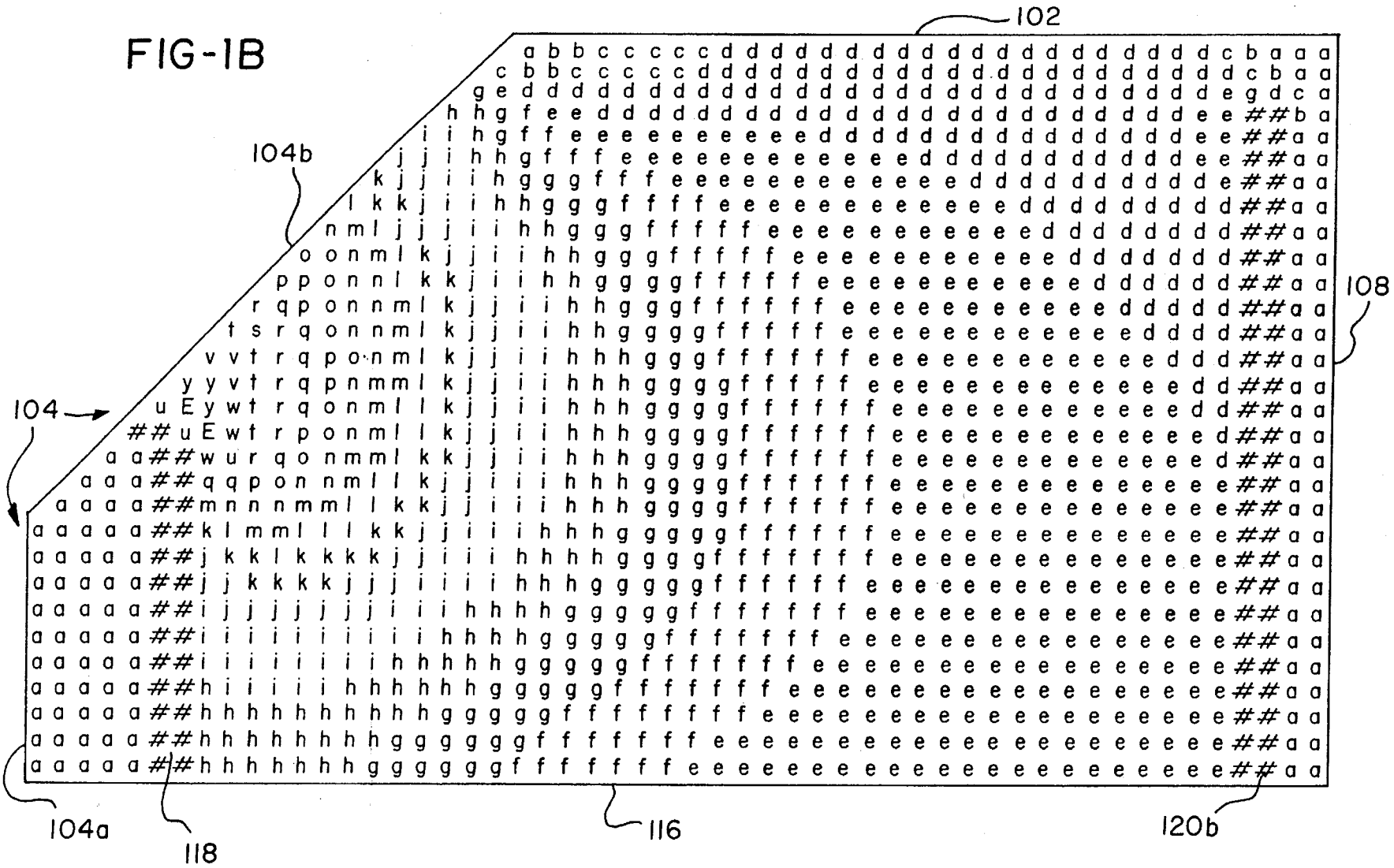
FIG. 1B is a schematic representation of the current (heat) distribution on the window of FIG. 1A when the window is electrically heated.
Figure 1C:
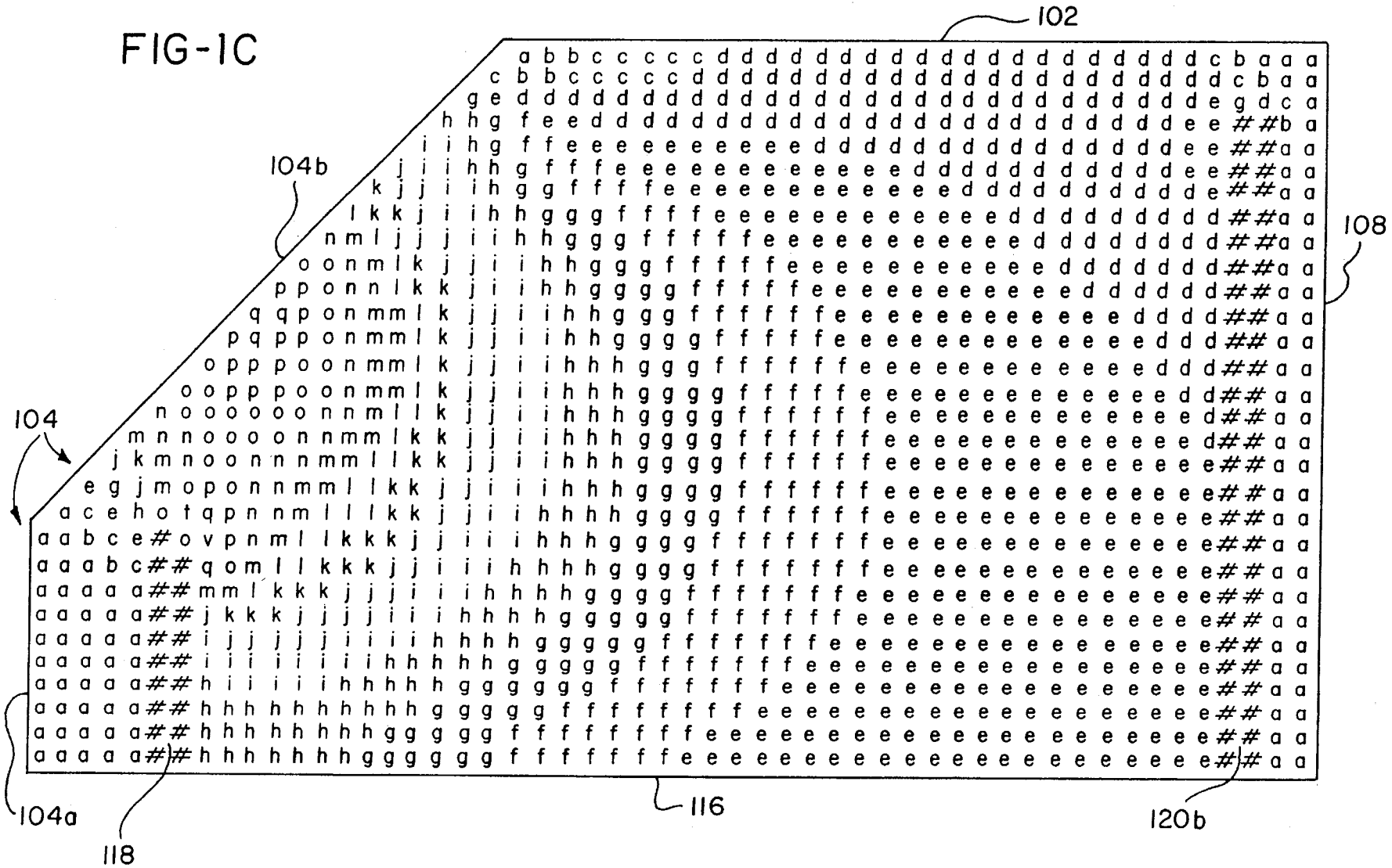
FIG. 1C is a schematic representation of the current (heat) distribution on the window resulting when the first bus bar of FIG. 1A is shortened.

The current density, or heating, pattern produced by the electrically heated window assembly 100 is schematically shown in FIGS. 1B and 1C. The current density is zero at "a" and increases uniformly with each successive letter change. (a,b,c . . . x,y,z,A,B,C . . . etc.) The number symbol "#" indicates the location of either the first bus bar 118 or the second section 120*b* of the second bus bar 120. Only the area of the window 102 above the nonconductive break 116 is represented in FIGS. 1B and 1C. It should be understood that the current density patterns shown in FIGS. 1B and 1C are mathematically generated representations illustrative of the general heating concept of the respective embodiments of the present invention and do not represent actual measured window heating patterns.

FIG. 1B shows the current density pattern, and thus the heating pattern, of the electrically heated window assembly 100 of FIG. 1A having the first bus bar 118 extending substantially to the inclined front section 104*b* of the front edge 104. As is apparent from FIG. 1B, the maximum current (designated as "E") is concentrated near a tip 118*a* of the first bus bar 118 which is at or near the portion 112 of the window 102 through which the driver views the exterior rear view mirror 121*a*. Since a significant portion of the second section 120*b* of the second bus bar 120 is nearer to the tip 118*a* of the first bus bar 118, the current concentrates at the tip 118*a*.

FIG. 1C shows the current density pattern of the electrically heated window assembly 100 of FIG. 1A having a shortened first bus bar 118. The current remains concentrated at the tip 118*a* of the first bus bar 118; however, the location of maximum current (represented in this example by "v") is moved away from the inclined front section 104*b* of the window 102. As is well known, it is advantageous to reduce the current flowing along the edge of the window 102 since such current heats portions of the window not used for viewing exterior rear mirrors resulting in inefficient heating.

Figure 2A:
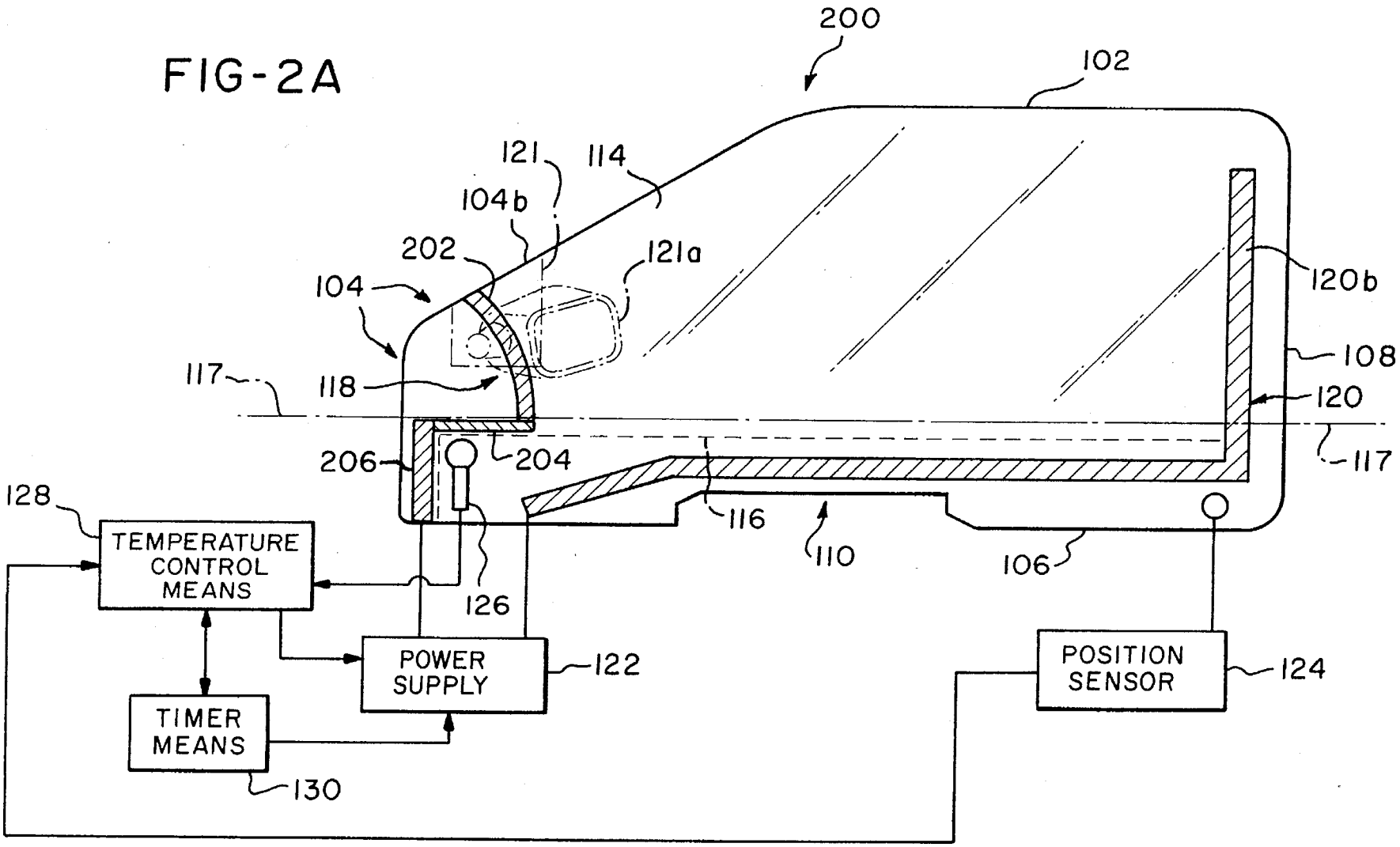
FIG. 2A is a side view of an electrically heated window assembly including a movable front door window (side lite) and first and second bus bars wherein the first bus bar is arcuately shaped.

An alternative embodiment of the present invention is shown in FIG. 2A. For ease of description and clarity, like elements shown in FIGS. 1A and 2A have like reference numerals. In the electrically heated window assembly 200 shown in FIG. 2A, the first bus bar 118 consists of an arcuately-shaped member 202, a horizontal member 204 and a vertical member 206. All of the members 202, 204 and 206 are electrically interconnected. Vertical member 206 is adapted to be connected to power supply 122. In this embodiment, current flows via the conductive film 114 between the arcuately-shaped member 202 of the first bus bar 118 and the second section 120*b* of the second bus bar 120. Otherwise, the operation of the window assembly 200 is substantially identical to the operation of the window assembly 100 as described above and, therefore, further description will not be set forth here.

Figure 2B:
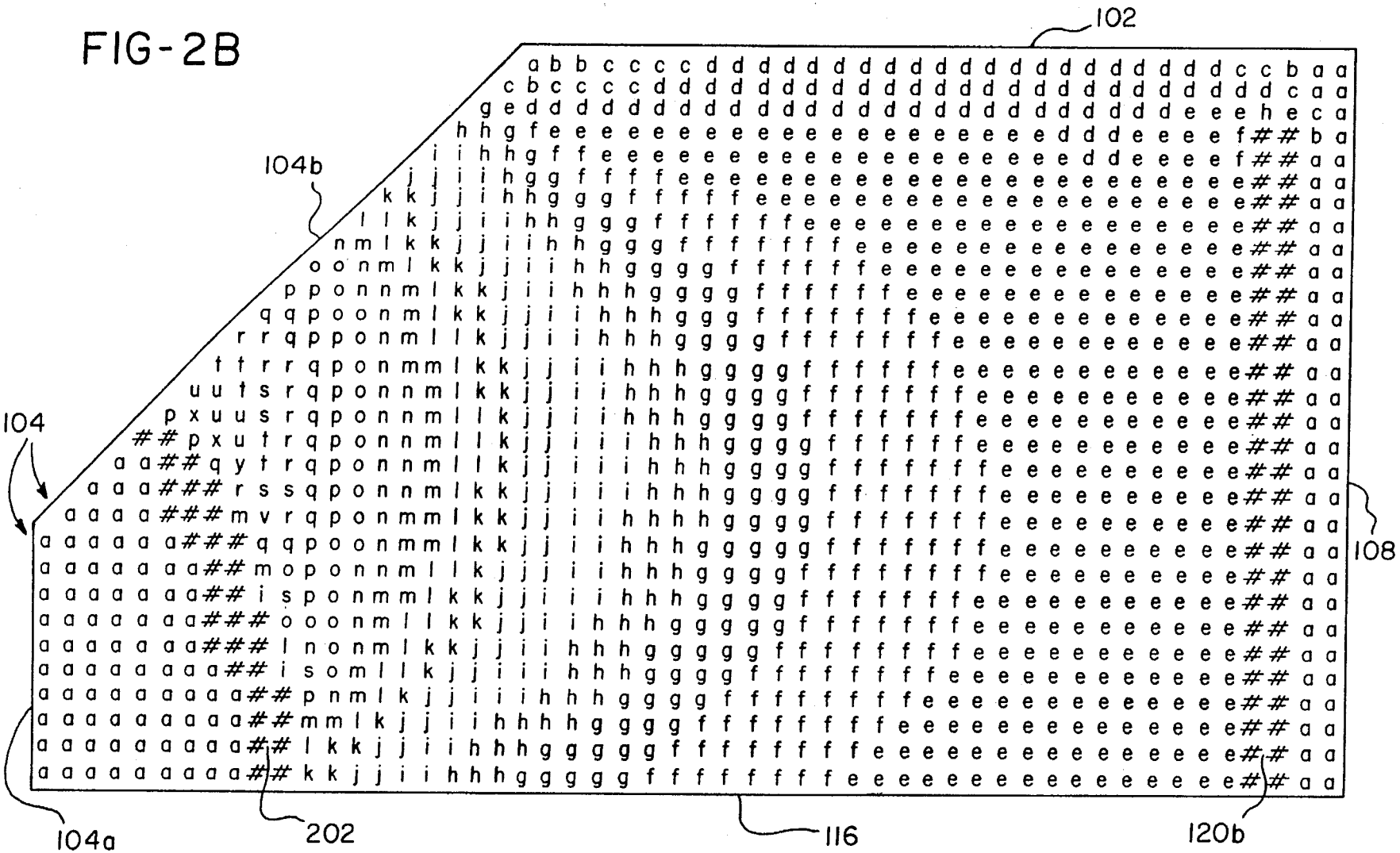
FIG. 2B is a schematic representation of the current (heat) distribution generated by the window assembly illustrated in FIG. 2A.

FIG. 2B shows the current density pattern of the window assembly 200 of FIG. 2A including the arcuately-shaped member 202 of the first bus bar 118. As is apparent, the use of the arcuately-shaped member 202 has reduced the maximum current density from "E" in FIG. 1B to "x" in FIG. 2B while providing an increased level of heating at the portion of the window 102 through which a driver or passenger views an exterior rear view mirror. Furthermore, the areas of equal heating (such as the area defined by contiguous "k"s) curve downward from the inclined front section 104*b* to the nonconductive break 116 resulting in a more uniform heating pattern across the window 102. To obtain a uniform heating pattern, it has been shown that the tangent to the arc of the arcuately-shaped member 202 should be perpendicular to the inclined front section 104*b* of the window 102.

Having thus described the window assembly and method for heating a window of the present invention in detail and by reference to preferred embodiments thereof, it will be apparent that modifications and variations are possible without departing from the scope of the invention defined in the appended claims.

What is claimed is:

1. An electrically heated motor vehicle window assembly movably mounted in a front door of a motor vehicle, said window assembly comprising:

a window having a front edge, a bottom edge and a rear edge;

a first bus bar having an arcuately-shaped member positioned adjacent said front edge of said window, said first bus bar being adapted to connect to a power supply;

a second bus bar having a first section positioned along said bottom edge of said window and a section positioned along said rear edge of said window so as to be beneath the nominal door line of the front door, said first and second sections being electrically interconnected, said second bus bar being adapted to connect to said power supply; and an electrically conductive transparent film on said window which electrically interconnects said first bus bar and said window is heated when said first bus bar and said second bus bar are connected to said power supply, said conductive coating having a nonconductive break therein for electrically isolating said first section of said second bus bar from said first bus bar;

wherein the front door has a rear mirror mount assembly having an exterior rear view mirror mounted thereon, the rear mirror mount assembly enclosing a portion of said front edge of said window when said window is closed, and said first bus bar is positioned along said front edge of said window such that said first bus bar is enclosed by the rear mirror mount assembly.

2. The window assembly as recited in claim 1 wherein said nonconductive break is located substantially along the nominal door line of the front door when said window is closed.

3. The window assembly as recited in claim 1 further comprising at least one temperature sensor for detecting temperature of said window.

4. The window assembly as recited in claim 1 further comprising a timer means for automatically interrupting said electrical interconnection between said first bus bar and said second section of said second bus bar at a predetermined time.

* * * * *